US007651757B2

(12) United States Patent
Jones et al.

(10) Patent No.: US 7,651,757 B2
(45) Date of Patent: Jan. 26, 2010

(54) FLOOR UNDERLAYMENT

(75) Inventors: Matt Jones, St. Charles, MO (US); David Rives, Grapevine, TX (US); Natarajan S. Ramesh, Grapevine, TX (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 750 days.

(21) Appl. No.: 11/216,777

(22) Filed: Aug. 31, 2005

(65) Prior Publication Data

US 2007/0062139 A1 Mar. 22, 2007

(51) Int. Cl.
*B32B 3/00* (2006.01)
*E04F 15/22* (2006.01)

(52) U.S. Cl. ..... 428/172; 428/158; 428/318.6; 52/309.8; 52/403.1; 52/408

(58) Field of Classification Search ..... 428/158, 428/159, 160, 172, 318.4, 318.6, 318.8; 52/309.8, 309.9, 403.1, 408, 789.1
See application file for complete search history.

(56) References Cited

U.S. PATENT DOCUMENTS

| | | | |
|---|---|---|---|
| 3,010,899 | A | 11/1961 | Boyer |
| 3,222,697 | A | 12/1965 | Scheermesser |
| 3,664,906 | A | 5/1972 | Hartig |
| 4,096,304 | A | 6/1978 | Greengrass |
| 4,170,675 | A | 10/1979 | Greengrass |
| 4,191,798 | A | 3/1980 | Schumacher et al. |
| 4,222,924 | A | 9/1980 | Schumacher |
| 4,263,196 | A | 4/1981 | Schumacher et al. |
| 4,379,190 | A | 4/1983 | Schenck |
| 4,403,007 | A | 9/1983 | Coughlin |
| 4,430,468 | A | 2/1984 | Schumacher |
| 4,434,258 | A | 2/1984 | Schumacher et al. |
| 4,434,261 | A | 2/1984 | Brugel et al. |
| 4,438,228 | A | 3/1984 | Schenck |
| 4,469,741 | A | 9/1984 | Akao |
| 4,472,545 | A | 9/1984 | Coughlin et al. |
| 4,480,061 | A | 10/1984 | Coughlin et al. |
| 4,492,064 | A | 1/1985 | Bynoe |
| 4,614,556 | A | 9/1986 | Fry et al. |
| 4,614,680 | A | 9/1986 | Fry et al. |

(Continued)

FOREIGN PATENT DOCUMENTS

| | | | |
|---|---|---|---|
| JP | 2000-289133 | A1 | 10/2000 |

(Continued)

*Primary Examiner*—Donald Loney
(74) *Attorney, Agent, or Firm*—Alston & Bird LLP

(57) ABSTRACT

The invention is directed to a floor underlayment material comprising a film sheet having an inner surface attached to a foam sheet and an outer surface including a plurality of recesses formed therein. The plurality of recesses define one or more fluid pathways through which a fluid may migrate across the outer surface of the film layer. The underlayment material may be used in a flooring system to help prevent or limit the accumulation of a fluid between the floor and the subfloor. In one embodiment, the underlayment material may be disposed between a subfloor and floor with the outer surface of the film layer being disposed adjacent to the underside of the floor. The one or more fluid pathways provide channels through which a fluid such as moisture vapor may escape from within a flooring system and thereby reduce the accumulation of moisture in the flooring system.

21 Claims, 6 Drawing Sheets

U.S. PATENT DOCUMENTS 4,642,959 A 2/1987 Swiech, Jr. et al.
4,832,152 A 5/1989 Schuelke et al.
4,874,657 A 10/1989 Lo et al.
4,929,483 A 5/1990 Halg et al.
5,021,108 A 6/1991 Bergqvist
5,067,298 A 11/1991 Petersen
5,244,942 A 9/1993 Hover et al.
5,298,694 A 3/1994 Thompson et al.
5,348,984 A 9/1994 Lee
5,462,974 A 10/1995 Lee
5,617,687 A 4/1997 Bussey et al.
5,667,728 A 9/1997 Lee
5,695,870 A 12/1997 Kelch et al.
5,731,069 A 3/1998 Delle Donne et al.
5,766,721 A * 6/1998 Bussey et al. ..... 428/71
5,792,539 A 8/1998 Hunter
5,886,306 A 3/1999 Patel et al.
5,888,614 A 3/1999 Slocum et al.
5,928,754 A 7/1999 Kondo et al.
5,952,076 A 9/1999 Foster
5,968,630 A 10/1999 Foster
6,010,766 A 1/2000 Braun et al.
6,030,696 A 2/2000 Lee
6,037,033 A 3/2000 Hunter
6,080,495 A 6/2000 Wright
6,128,879 A 10/2000 Bussey, Jr. et al.
6,148,586 A 11/2000 Jandl
6,253,526 B1 7/2001 Murphy et al.
6,284,346 B1 9/2001 Sheridan
6,316,016 B1 11/2001 Iwakawa
6,358,599 B1 3/2002 Deibel et al.
6,454,981 B1 9/2002 Lee et al.
6,468,629 B1 * 10/2002 Lodder ..... 428/158
6,482,496 B1 11/2002 Wycech
2001/0046581 A1 11/2001 Brumbelow et al.

FOREIGN PATENT DOCUMENTS

WO WO 91/10023 A1 7/1991

* cited by examiner

FLOOR UNDERLAYMENT

FIELD OF THE INVENTION

The present invention relates to foam laminates and in particular to foam laminates for use as a floor underlayment.

BACKGROUND OF THE INVENTION

Many flooring systems in residential and commercial buildings may comprise a floor supported by wood or steel joists. In some flooring systems the floor may comprise a finished floor that is disposed above a subfloor. In single-family and multi-family homes and small commercial buildings, the subfloor may comprise a poured concrete slab or be formed from wooden boards or panels that are laid over the joists. In some apartment buildings, larger commercial buildings and other steel-frame buildings, the subfloor may be a steel deck, precast concrete slabs or panels, or poured concrete.

The finished flooring provides a decorative, aesthetically pleasing floor surface. The finished flooring may be wood, such as wood planks, parquet flooring and wood-block flooring, or a resilient material, such as linoleum, asphalt tile, or vinyl or rubber tile or sheet, or carpeting.

Concrete typically comprises a combination of aggregate and a cement binder having a high water content. After mixing, the cement hydrates and eventually hardens into a hard stone-like material. In many cases, the concrete retains a high moisture content that may slowly dissipate from within the concrete over a period of time. In some cases, concrete may also wick moisture from the surrounding environment, such as the ground, into the concrete. Moisture from within the concrete may dissipate upwardly through the concrete and come into contact with the floor.

Hardwood flooring and wood in general are hygroscopic materials. Liquid water and water vapor can enter wood which may cause it to swell and change its shape and size, potentially causing bubbling. If and when the water leaves the wood, the wood can shrink which may result in warp, the development of small cracks in the surface of the wood, twists, bows, or even develop cups or dips within each piece of wood flooring. In some cases, cracks in between pieces of wood may open up as the wood dries.

To help prevent moisture from contacting the finished flooring, it may be desirable to place a moisture barrier between the flooring and the subfloor. The moisture barrier may comprise a thin layer of film adhered to the surface of the concrete. In some applications an underlayment layer comprising a layer of film and a layer of foam, or a polyethylene film/foam laminate, is provided as an underlayment between the concrete subfloor and finish flooring formed of wood. The underlayment levels small irregularities in the top surface of the concrete, provides a small degree of resiliency to the floor system, and provides a vapor barrier to prevent moisture emanating from the concrete subfloor from attacking and deteriorating the finish flooring.

Despite the advantages provided by barrier films and floor underlayments, many barrier films may permit some transmission of water vapor. In some cases, water vapor may be trapped between the flooring and underlayment. This may result in the development of mold, fungus and other growths, leading to odors and other health concerns. In addition, because of the tendency of these underlayments to trap moisture, they may not be usable with wood subfloors which would deteriorate on prolonged exposure to moisture.

In some flooring systems, a temperature gradient may exist between the subfloor and the finished floor. In some cases, this temperature gradient may result in temperature variations within the underlayment. Temperature variations within the underlayment may adversely affect the underlayment. For example, a temperature gradient may cause one or more portions of the underlayment material to prematurely fail, such as the formations of cracks and/or deterioration or delamination of the foam and film layers.

Thus, there exists a need for an improved floor underlayment which provides the cushioning, and floor leveling functions of the prior floor underlayments, but which also permits the controlled escape of moisture from the subfloor so as to avoid the disadvantages associated therewith.

BRIEF SUMMARY OF THE INVENTION

The invention provides a floor underlayment material that overcomes many of the problems discussed above. In one embodiment, the invention is directed to a floor underlayment material comprising a film sheet having an inner surface attached to a foam sheet and an outer surface including a plurality of recesses formed therein. The plurality of recesses define one or more fluid pathways through which a fluid may migrate across the outer surface of the film layer.

In one embodiment, the underlayment material may be used in a flooring system to help prevent or limit the accumulation of a fluid between the floor and the subfloor. In one alternative embodiment, the underlayment material may be disposed between a subfloor and floor with the outer surface of the film layer being disposed adjacent to the underside of the floor. The one or more fluid pathways provide channels through which a fluid such as moisture vapor may escape from within a flooring system and thereby reduce the accumulation of moisture in the flooring system. Migration of moisture vapor through the underlayment material may result in the moisture vapor exiting the film layer and entering one or more of the plurality of recesses. The moisture vapor may then migrate through a series of adjacent recesses until it reaches an opening in the flooring system through which it may escape into the surrounding atmosphere. In other embodiments, the underlayment material may be disposed between a subfloor and floor with the outer surface of the film layer being disposed adjacent to the subfloor.

In one embodiment, a fluid migrating across the outer surface of the film layer may select from multiple different fluid pathways. In some embodiments, each recess may be interconnected to two or more adjacent recesses. As a result, fluids migrating through a recess may be able to discriminate amongst adjacent recesses in selecting into which recess it may migrate next. The fluid pathway through which the fluids may migrate may be based, at least in part, on which pathway has a higher vapor transmission rate. The plurality of recesses may permit the fluids to select a fluid pathway having the least amount of resistance than alternative fluid pathways. As a result, a fluid may migrate through the recesses in a fluid pathway that may provide the most efficient route of escape from within the flooring system.

In one alternative embodiment, the invention is directed to a flooring system wherein the underlayment material is disposed between a wood floor and a concrete subfloor. As discussed above, the plurality of fluid pathways provides a means whereby moisture vapor may escape the flooring system and thereby prevent the accumulation of trapped fluids.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1*a* is a cross-sectional side view of an underlayment material having a plurality of recesses through which a fluid may migrate across an outer surface of the underlayment material;

FIG. 1*b* is a cross-sectional side view of an underlayment material having plurality of wave-like recesses that extend across a surface of the underlayment material;

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
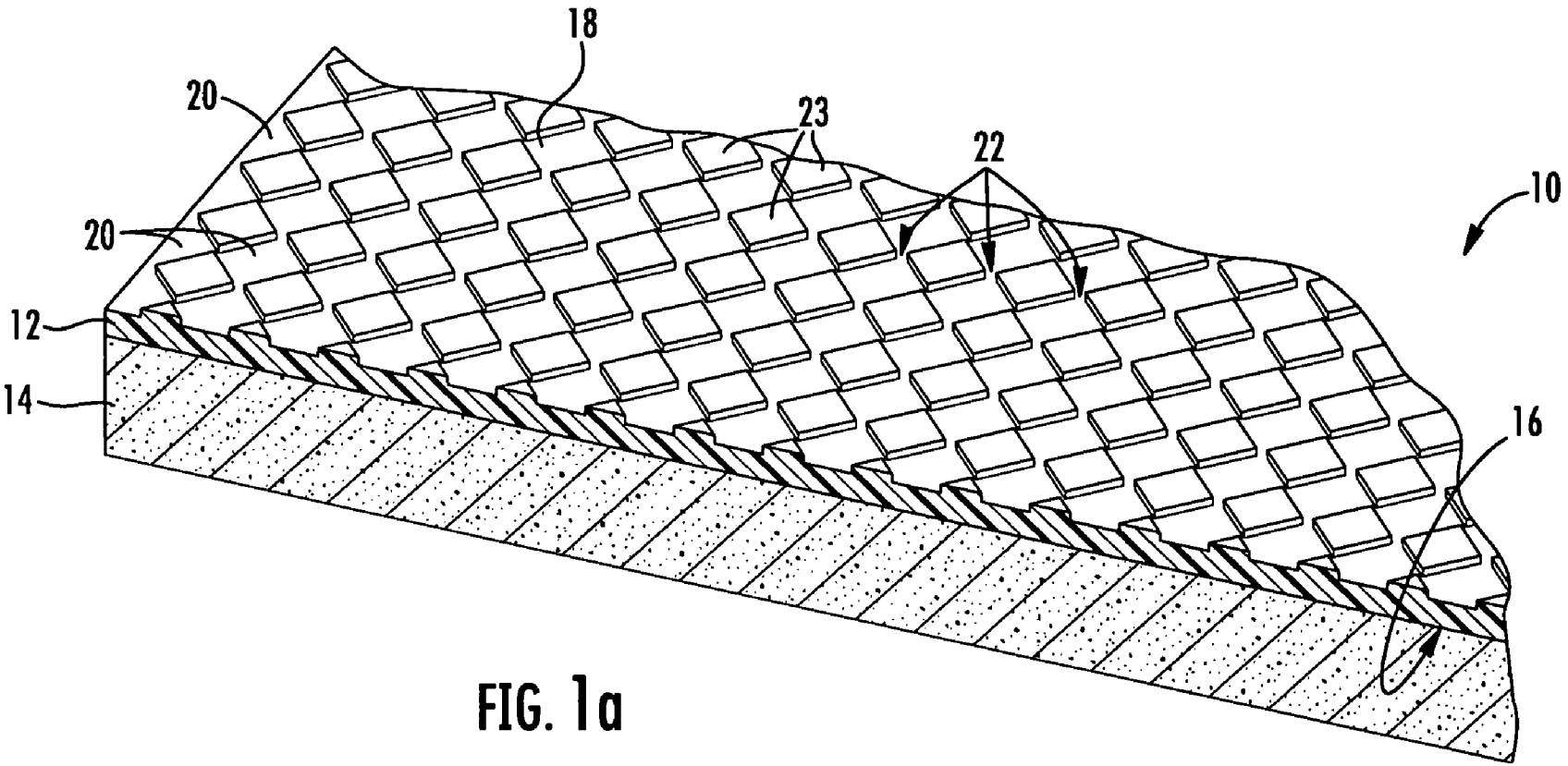
Figure 1B:
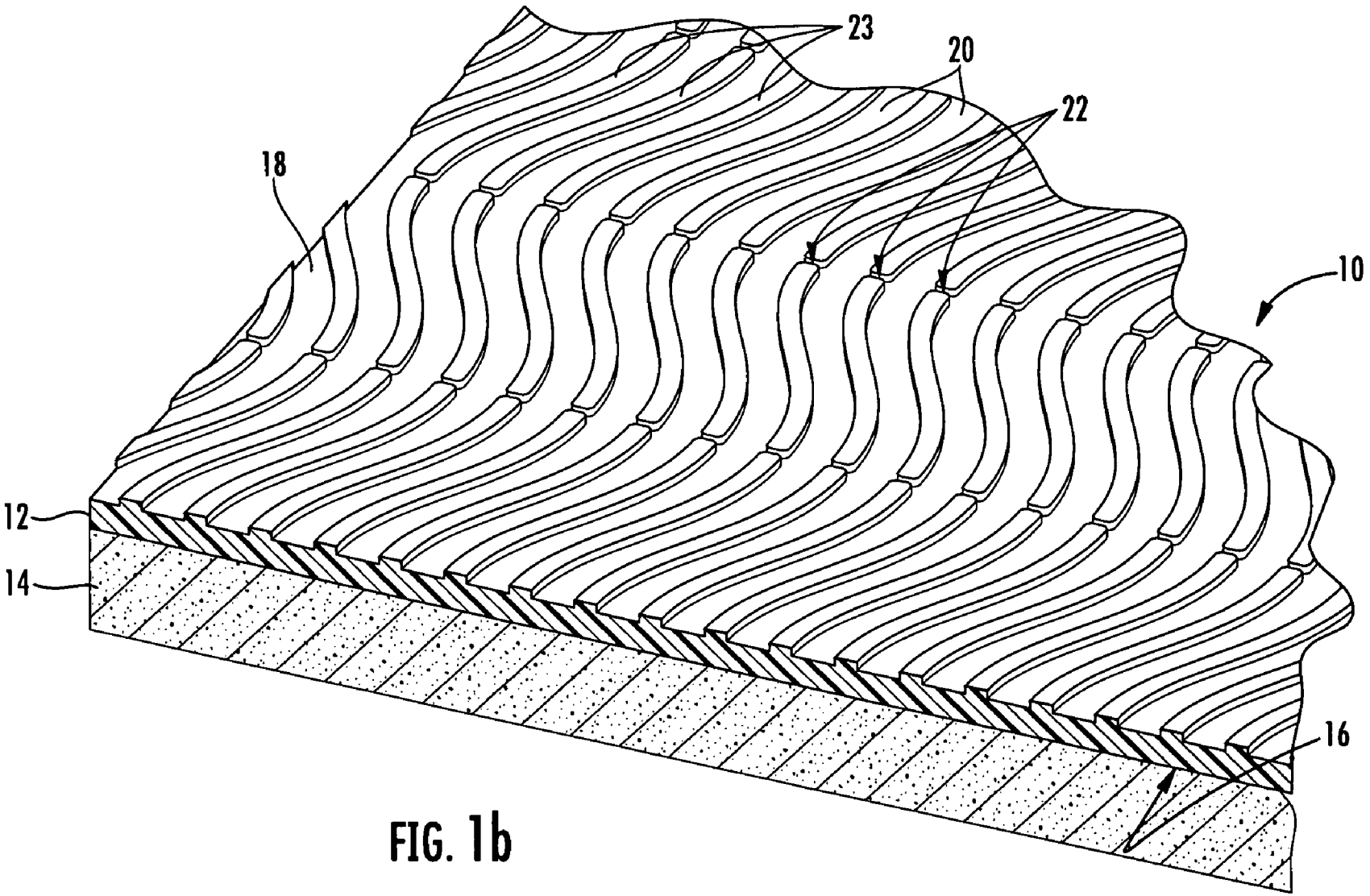

With reference to FIGS. 1*a* and 1*b*, a floor underlayment material having one or more fluid pathways is illustrated and broadly designated by reference number 10. The one or more fluid pathways provide channels through which moisture may escape from within a flooring system and thereby reduce the accumulation of moisture in the flooring system. In one embodiment, the underlayment material 10 comprises a film layer 12 having an inner surface 16 that is attached to a foam layer 14. The outer surface 18 of the film layer includes one or more fluid pathways through which a fluid is migratable across the outer surface of the film layer. In one alternative embodiment, the outer surface includes a plurality of recesses 20 that define the one or more fluid pathways. As discussed in greater detail below, the fluid pathways help prevent moisture vapor from becoming trapped within a flooring system. In the context of the invention, the term "fluid" includes liquids and gases, including air and moisture vapor. Fluids, embracing both liquids and gases, can typically flow easily across the outer surface of the film.

In FIG. 1*a* the outer surface 18 of the film layer includes a plurality of recesses 20 having a diamond-like shape. In some embodiments, each recess may include one or more connecting channels 22 that may interconnect one or more adjacent recesses. In one embodiment, the outer surface of the film layer may include a plurality of raised surfaces 23 in which the plurality of recesses 20 are formed. FIG. 1*b* illustrates an embodiment of the underlayment material wherein the plurality recesses have a "wave-like" shape that may extend longitudinally across the outer surface of the film layer. In some embodiments, outer surface of the film layer may include a plurality of the wave-like recesses 20 that are substantially parallel to each other. In one embodiment, the plurality of the wave-like recesses 20 may be defined by raised surfaces 23. In one alternative embodiment, the one or more of the wave-like recesses may be interconnected to one or more adjacent recesses via connecting channels 22 that extend laterally across the raised surfaces 23. As discussed in greater detail below, the plurality of recesses and connecting channels provide one or more fluid pathways through which a fluid may travel across the surface of the film layer.

In one embodiment, the wave-like recesses may have a width ranging from about 10 to about 250 mils, 20 to 200 mils, 50 to 150 mils, and from 75 to 125 mils. In some embodiments, the wave-like recesses may have a width ranging from about 100 to about 125 mils.

During extended use, many prior art underlayment materials have a tendency to compress as a result of exposure to foot traffic or heavy items. In some embodiments, the shape and surface area of the raised surfaces 23 may be configured so that this so-called "creep" of the underlayment material may be minimized.

In one embodiment, the one or more fluid passageways may also promote air flow across the surface of the film layer. Heat energy transfers between a solid and a fluid when there is a temperature difference between the fluid and the solid. This is generally known as "convection heat transfer". Convection heat transfer within the underlayment material may help lessen the amount of thermal variation that may be present in the underlayment material. In addition, convection heat transfer between the underlayment material and a fluid, such as air, in the one or more fluid passageways may also help induce fluid motion across the surface of the film layer. This is generally known as "natural convection" and it is generally a function of the temperature difference between the underlayment material and a fluid that may be present in the one or more fluid pathways. Convection forces within the underlayment material may permit and drive air flow through the one or more fluid passageways. Such air flow may provide several advantages, for example, the air flow may help the underlayment material to have a more uniform thermal distribution so the amount of thermal variation within the flooring system, and the underlayment material itself, may be reduced. In one embodiment, the thermal variation within a cross-sectional slice of the underlayment material may be less than 15° F., less than 10° F., and less than 5° F. Additionally, the air flow may also help a fluid, such as moisture vapor, to migrate across the surface of the film layer so that the fluid may efficiently escape from within the flooring system.

Figure 2:
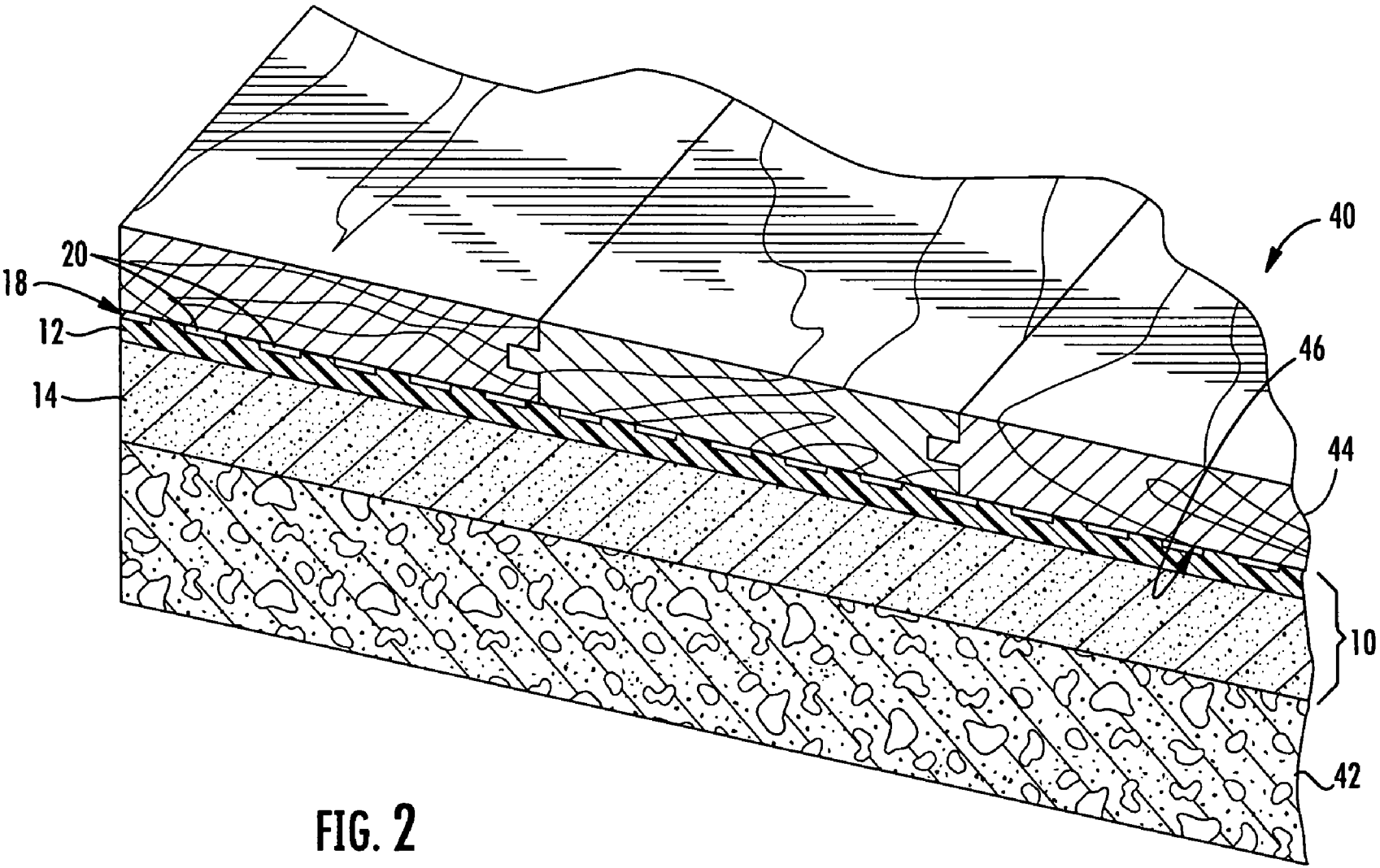
FIG. 2 is a cross-sectional side view of a flooring system including the underlayment material of FIG. 1*a;*

FIG. 2 is a cross-sectional side view of an exemplary flooring system 40 in which the underlayment material 10 is disposed between a subfloor 42 and a finished floor 44. The finished floor 44 as illustrated in FIGS. 2-5 comprises a series of wood or wood laminate planks fitted together at their edges. In the illustrated embodiment, the outer surface 18 including the plurality of recesses 20 are disposed adjacent to the underside 46 of the floor 44. In some embodiments, the foam layer 14 may be disposed adjacent to the subfloor 42. In other embodiments, the outer surface of the film layer may be disposed adjacent to the subfloor (see briefly FIG. 5).

Figure 3:
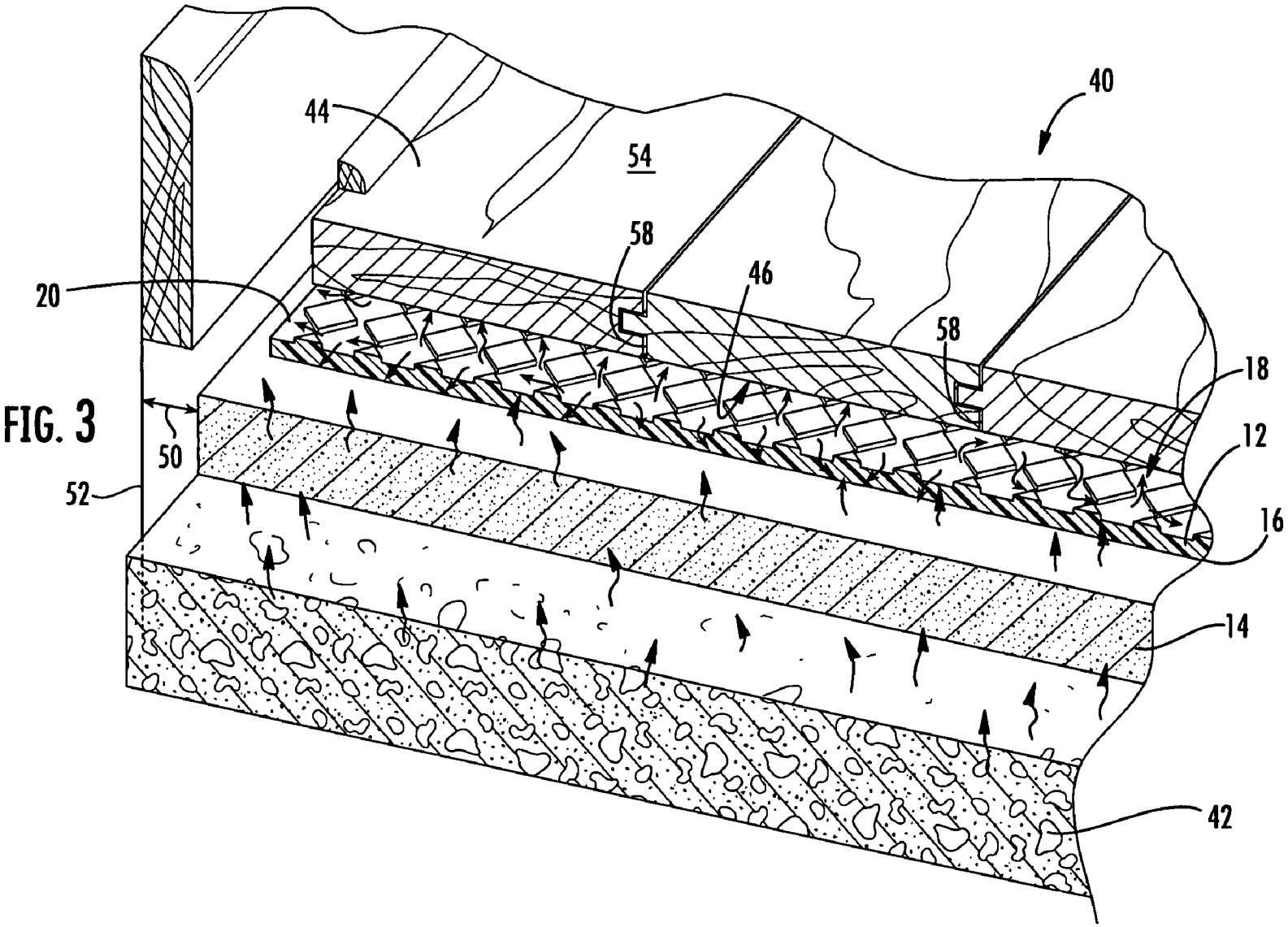
FIG. 3 is a perspective view of the flooring system of FIG. 1*a* with a portion of the floor and the underlayment removed for clarity.
Figure 4:
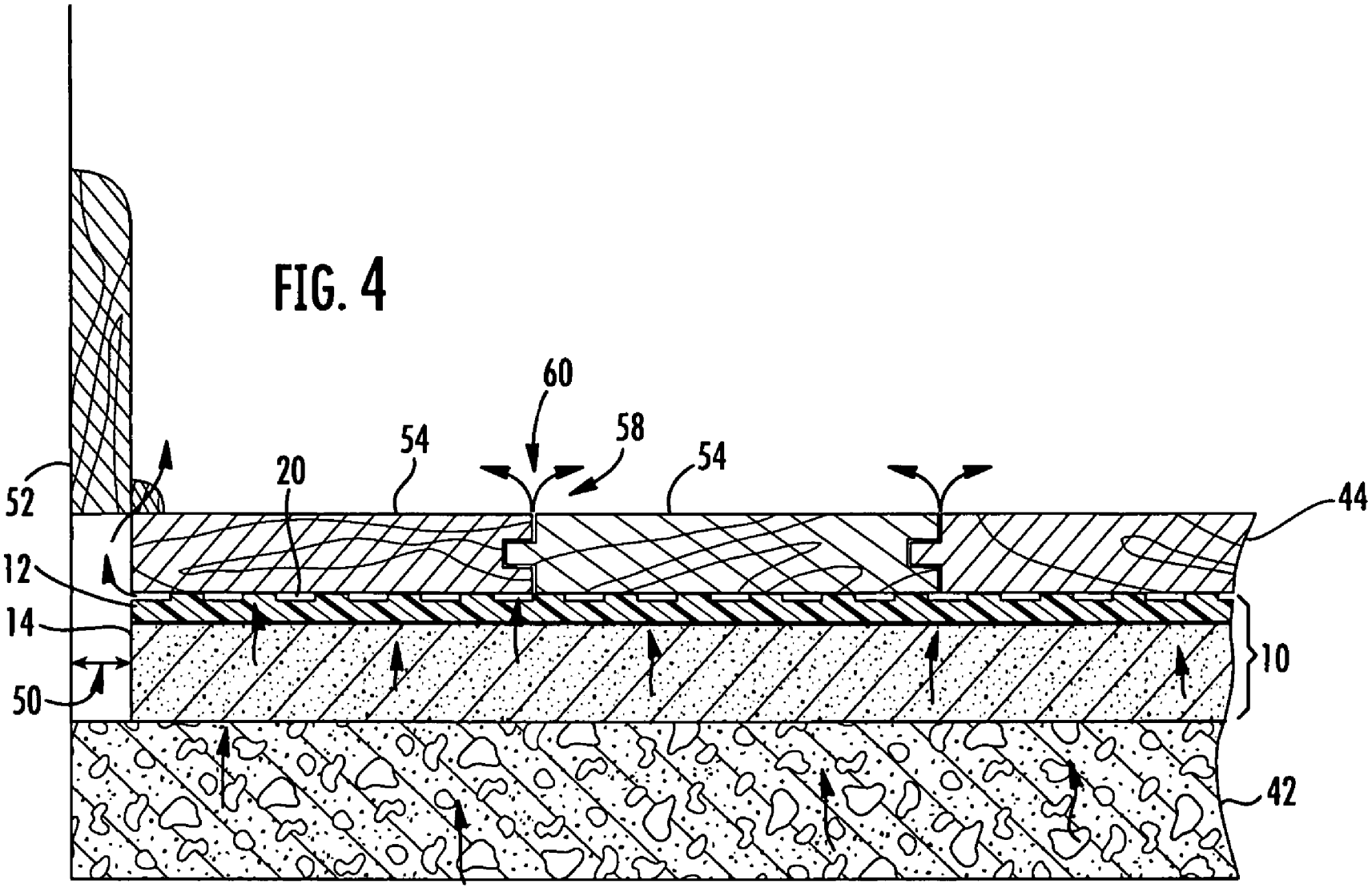
FIG. 4 is a cross-sectional side view of the flooring system of FIG. 2 depicting the migration of a fluid through the underlayment material.

As can best be seen in FIGS. 3 and 4, outer surface 18 includes a plurality of recesses 20 that are each capable of being in fluid communication with one or more adjacent recesses. The plurality of recesses define one or more fluid pathways through which a fluid may migrate across the outer surface of the film layer. The wavy arrows in FIGS. 3 and 4 illustrate a fluid, such as water vapor, migrating through the flooring system. FIG. 3 is a cross-sectional perspective view of a flooring system wherein portions of the flooring and the underlayment material have been removed for clarity. Moisture vapor, represented by the wavy arrows, is depicted as migrating upwardly from the subfloor and into the underlayment material 10. Continued migration of the moisture vapor results in the moisture vapor passing through foam and film layers, 14, 12. Moisture vapor may then be disposed between the underlayment material 10 and the underside 46 of the floor 44. Moisture vapor exiting the film layer 12 may migrate into one or more of the plurality of recesses. The moisture vapor may then migrate through a series of adjacent recesses until it reaches an opening in the flooring system through which it may escape into the surrounding atmosphere. The series of adjacent recesses define a fluid pathway through which moisture vapor may efficiently migrate through the flooring system. In one embodiment, the one or more fluid pathways comprise a network of interconnected recesses through which a fluid is migratable. As a result, the accumulation of trapped fluids within the flooring system may be reduced or prevented.

Moisture vapor migrating across the outer surface of the film layer may select from multiple different fluid pathways. In this regard, FIG. 3 depicts moisture vapor migrating through a series of successive and interconnected recesses as it migrates across the outer surface. In some embodiments, each recess may be interconnected to two or more adjacent recesses. As a result, moisture vapor migrating through a recess may be able to discriminate amongst adjacent recesses in selecting which recess it may next migrate into. The fluid pathway through which the water vapor migrates may be based, at least in part, on which pathway has a higher vapor transmission rate. The presence of the recessed structures provide clear channels for the moisture to move around due to the pressure gradient and natural convection effects. The plurality of recesses may permit the moisture vapor to select a fluid pathway providing the shortest path of escape or having the least amount of resistance (e.g., the highest moisture vapor transmission rate) than alternative fluid pathways. The one more fluid pathways defined by each successive recess comprise a dynamic system that can change with surrounding conditions such as humidity and temperature, for example. As a result, a fluid migrating across the outer surface of the film layer may not limited to migrating in any one direction or along any single predefined path and may migrate through the recesses in a pathway that may provide the most efficient route of escape from within the flooring system. Additionally, as discussed above, convection flow may also help a fluid migrate across the outer surface of the film layer.

As shown in FIG. 3, many conventional flooring systems provide some space 50 between the floor 44 and the wall 52. This space may permit some expansion and contraction of the floor 44 as the temperature and humidity of the surrounding environment changes. In some embodiments, the moisture vapor may migrate through the fluid pathways and into this space. From this space the moisture vapor may escape the flooring system into the surrounding atmosphere. In some embodiments, the floor may comprise laminate or wood planks that may be joined together lengthwise. In some floors, the planks may be joined together via tongue-in-groove joints. Over time as the floor is exposed to various changes in humidity and temperature, the space between adjacent planks may open and close as the planks expand and contract. Spaces between the planks may provide additional openings through which moisture vapor may escape the flooring system. In this regard, FIG. 4 illustrates a flooring system 40 in which the floor 44 comprises a plurality of wood planks 54 that are joined together via a tongue-in-groove joint 58. Moisture vapor is depicted as migrating through the underlayment material 10 and into the plurality of recesses 20. Depending upon the moisture vapor transmission rate of the fluid pathways, a first portion of the moisture vapor may escape the flooring system by migrating into the space 50 between the wall and the floor, and a second portion of moisture vapor may escape the flooring system by migrating through one or more openings 60 that may exist between the wood planks 54. Thus, the ability of the moisture vapor to migrate through a plurality of different recesses permits a fluid to select the most efficient route for exiting the flooring system.

In another embodiment, a portion or substantially all of the plurality of recesses may be interconnected with each other to form a network of one or more continuous fluid pathways. In this regard, FIG. 3 illustrates a plurality of recesses having a diamond-like shape and that are each connected to one or more adjacent diamond shaped recesses. Moisture vapor migrating into a recess may then select one or more of the adjacent recesses in which to migrate based on which one of the recesses provide a pathway of less resistance. In one alternative embodiment, the plurality of recesses may comprise a first plurality of substantially parallel channels that extend laterally across the outer surface and that intersect a second plurality of substantially parallel channels. The intersecting channels thereby form an outer surface having multiple possible fluid pathways. In other embodiments, the outer surface of the film layer may include a plurality of recesses that may not be directly connected to one another. It should also be recognized, that the shape, size, and depth of the plurality of the recess may be varied so that the outer surface provides one or more fluid pathways having a desired rate of moisture transmission.

Figure 5:
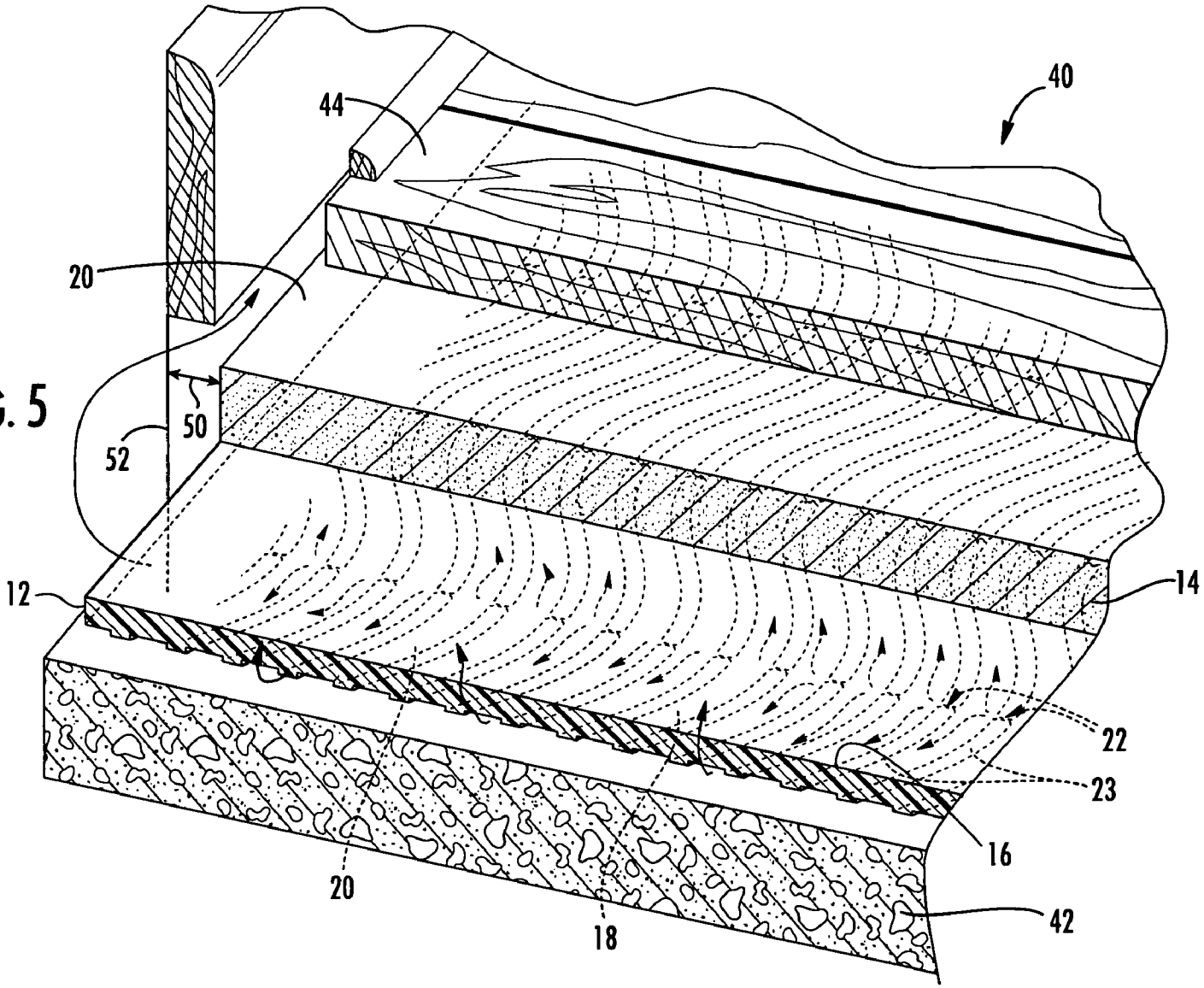
FIG. 5 is a perspective view of the flooring system of FIG. 1*b* with a portion of the floor and the underlayment removed for clarity.

In an alternative embodiment, the outer surface of the film layer may be disposed adjacent to the surface of the subfloor. In this regard, FIG. 5 illustrates a flooring system 40 wherein the outer surface 18 of the underlayment material is disposed adjacent to the subfloor 42. As discussed above, the plurality of recesses define one or more fluid pathways through which a fluid may migrate across the outer surface 18 of the film layer 12. As shown, in FIG. 5, the recesses may provide one or more fluid pathways through which a fluid, such as moisture vapor, may travel across the surface of the film layer. Here, a fluid, represented by the wavy arrows, is depicted as migrating through the fluid pathways. Connecting channels 23 may interconnect adjacent recesses 20 so that the fluid may move across the outer surface of the film layer in a direction that may provide the most efficient method of escaping the flooring system.

In the embodiment illustrated in FIG. 5, it may be desirable for the film layer to comprise a material having high moisture vapor barrier properties so that moisture vapor may be substantially prevented from migrating through the film layer and into the foam layer. In some embodiments, the film layer may have a water vapor transmission rate that is less than about 0.2 grams/day/100 $in^2$ at 100° F., 90% relative humidity as measured according to ASTM F1249-01. In other embodiments, the film layer may have a water vapor transmission rate that is no greater than about 0.25, 0.35, 0.50, or 0.75 grams/day/100 $in^2$ at 100° F., 90% relative humidity. In the illustrated embodiment, the plurality of recesses are depicted as having a wave-like shape. It should be recognized, however, that the pattern and shape of the plurality of recesses may be varied and is not dependent on any one particular shape or size.

In some embodiments, the underlayment material may comprise a second film layer (not illustrated) attached to an outer surface of the foam layer to produce a laminate wherein the foam layer is disposed between two film layers. The second film layer may have moisture vapor barrier properties. In some embodiments, the second film layer may also include an outer surface having a plurality of recesses that define one or more fluid pathways. In this embodiment, the underlayment material would provide two outer surfaces for channeling moisture vapor out of the flooring system.

In one embodiment, the underlayment material comprises a laminate in which the foam layer and the film are attached to one another. The film and foam layers may be attached together in a variety of known ways. Suitable methods of attaching the film and foam layers together include, but are not limited to, the application of an adhesive including a molten polymer, ultrasonic bonding, heat bonding, and the like. In one alternative embodiment, the underlayment material may be produced by extruding a layer of polymeric resin directly onto the foam layer to thereby form a film layer that is thermally adhered to the foam layer. In other embodiments, the underlayment material may be produced via heat lamination by feeding a sheet of foam and a sheet of film through a pair of heated rolls that softens and fuses the film layer to a surface of the foam layer.

In one embodiment, the recesses may comprise a plurality of imprinted depressions that are formed on the outer surface of the film layer. The recesses may be formed on the outer surface in a variety of ways including extrusion molding techniques. In one alternative embodiment, the recesses comprise imprinted depressions that may be formed by passing the film layer through an embossing roll or other type of roll having a plurality raised or depressed surfaces disposed on the outer circumference of the roll. In some embodiments, the recesses may be formed by passing a sheet of the underlayment material through an embossing roll. The height, size, and spacing of the raised surface may be varied so that the outer surface has a desired rate of moisture vapor transmission.

In some embodiments, the outer surface of the film layer may be substantially covered with a plurality of recesses. The depth of the recesses may be selected so that the a fluid is capable of flowing across the outer surface of the underlayment material at a desired rate. In one embodiment, the moisture vapor transmission rate across the outer surface of the film is greater than 0.23 grams/day/100 $in^2$. The depth of the recesses may range from about 1 to 45 mils. In one alternative embodiment, the average depth of the recesses is between about 2 to 20 mil or 3 to 19 mil. In other embodiments, the recesses may have an average depth that is about 10 mil. In one embodiment, the recesses cover about 5 percent of the surface area of the outer surface. In other embodiments, the recesses may cover greater than about 7.5, 10, 15, 20, 25, and 50 percent of the surface area of the outer surface.

In some embodiments, the film layer comprises a polymeric material having high moisture barrier properties, such as a water vapor permeability that is less than about 0.2 grams/day/100 $in^2$ at 100° F., 90% relative humidity as measured according to ASTM F1249-01. In other embodiments, the film layer may comprise a polymeric material having low barrier properties, such as a water vapor permeability that is greater than about 0.3 grams/day/100 $in^2$ at 100° F., 90% relative humidity as measured according to ASTM F1249-01. In some embodiments, the film layer has a water vapor permeability that is greater than about 0.2, 0.23, 0.25, or 0.28 grams/day/100 $in^2$ at 100° F., 90% relative humidity as measured according to ASTM F1249-01. In some embodiments, it may be desirable for the underlayment material to have a high water vapor permeability. For instance, a high water vapor permeability may permit fluids to quickly migrate through the underlayment material and into the fluid pathways. Thereafter the fluid may migrate through the fluid pathways so that it can efficiently and quickly escape the flooring system.

The film layer may include one or more thermoplastic polymers including polyolefins, polystyrenes, polyurethanes, polyvinyl chlorides, polyesters, and ionomers provided that the desired properties of the film layer may be maintained.

Suitable polyolefins for use as the film layer may include LLDPE, low density polyethylene, high density polyethylene, metallocene catalyzed polyethylene, polypropylene, and oriented polypropylene, ethylene homo- and co-polymers and propylene homo- and co-polymers. Ethylene homopolymers include high density polyethylene ("HDPE") and low density polyethylene ("LDPE"). Ethylene copolymers include ethylene/alpha-olefin copolymers ("EAOs"), ethylene/unsaturated ester copolymers, and ethylene/(meth) acrylic acid. ("Copolymer" as used in this application means a polymer derived from two or more types of monomers, and includes terpolymers, etc.).

EAOs are copolymers of ethylene and one or more alpha-olefins, the copolymer having ethylene as the majority mole-percentage content. In some embodiments, the comonomer includes one or more $C_3$-$C_{20}$ alpha-olefins, more preferably one or more $C_4$-$C_{12}$ alpha-olefins, and most preferably one or more $C_4$-$C_8$ alpha-olefins. Particularly useful alpha-olefins include 1-butene, 1-hexene, 1-octene, and mixtures thereof.

EAOs include one or more of the following: 1) medium density polyethylene ("MDPE"), for example having a density of from 0.93 to 0.94 g/$cm^3$; 2) linear medium density polyethylene ("LMDPE"), for example having a density of from 0.926 to 0.94 g/$cm^3$; 3) linear low density polyethylene ("LLDPE"), for example having a density of from 0.915 to 0.930 g/cm3; 4) very-low or ultra-low density polyethylene ("VLDPE" and "ULDPE"), for example having density below 0.915 g/$cm^3$; and 5) homogeneous EAOs. Useful EAOs include those having a density of less than about any of the following: 0.925, 0.922, 0.92, 0.917, 0.915, 0.912, 0.91, 0.907, 0.905, 0.903, 0.9, and 0.898 grams/cubic centimeter. Unless otherwise indicated, all densities herein are measured according to ASTM D1505.

The polyethylene polymers may be either heterogeneous or homogeneous. As is known in the art, heterogeneous polymers have a relatively wide variation in molecular weight and composition distribution. Heterogeneous polymers may be prepared with, for example, conventional Ziegler Natta catalysts.

On the other hand, homogeneous polymers are typically prepared using metallocene or other single site-type catalysts. Such single-site catalysts typically have only one type of catalytic site, which is believed to be the basis for the homogeneity of the polymers resulting from the polymerization. Homogeneous polymers are structurally different from heterogeneous polymers in that homogeneous polymers exhibit a relatively even sequencing of comonomers within a chain, a mirroring of sequence distribution in all chains, and a similarity of length of all chains. As a result, homogeneous polymers have relatively narrow molecular weight and composition distributions. Examples of homogeneous polymers include the metallocene-catalyzed linear homogeneous ethylene/alpha-olefin copolymer resins available from the Exxon Chemical Company (Baytown, Tex.) under the EXACT trademark, linear homogeneous ethylene/alpha-olefin copolymer resins available from the Mitsui Petrochemical Corporation under the TAFMER trademark, and long-chain branched, metallocene-catalyzed homogeneous ethylene/alpha-olefin copolymer resins available from the Dow Chemical Company under the AFFINITY trademark.

Another useful ethylene copolymer is ethylene/unsaturated ester copolymer, which is the copolymer of ethylene and one or more unsaturated ester monomers. Useful unsaturated esters include: 1) vinyl esters of aliphatic carboxylic acids, where the esters have from 4 to 12 carbon atoms, and 2) alkyl esters of acrylic or methacrylic acid (collectively, "alkyl (meth)acrylate"), where the esters have from 4 to 12 carbon atoms.

Representative examples of the first ("vinyl ester") group of monomers include vinyl acetate, vinyl propionate, vinyl hexanoate, and vinyl 2-ethylhexanoate. The vinyl ester monomer may have from 4 to 8 carbon atoms, from 4 to 6 carbon atoms, from 4 to 5 carbon atoms, and preferably 4 carbon atoms.

Representative examples of the second ("alkyl (meth)acrylate") group of monomers include methyl acrylate, ethyl acrylate, isobutyl acrylate, n-butyl acrylate, hexyl acrylate, and 2-ethylhexyl acrylate, methyl methacrylate, ethyl methacrylate, isobutyl methacrylate, n-butyl methacrylate, hexyl methacrylate, and 2-ethylhexyl methacrylate. The alkyl (meth)acrylate monomer may have from 4 to 8 carbon atoms, from 4 to 6 carbon atoms, and preferably from 4 to 5 carbon atoms.

The unsaturated ester (i.e., vinyl ester or alkyl (meth)acrylate) comonomer content of the ethylene/unsaturated ester copolymer may range from about 3 to about 18 weight %, and from about 8 to about 12 weight %, based on the weight of the copolymer. Useful ethylene contents of the ethylene/unsaturated ester copolymer may include the following amounts: at least about 82 weight %, at least about 85 weight %, at least about 88 weight %, no greater than about 97 weight %, no greater than about 93 weight %, and no greater than about 92 weight %, based on the weight of the copolymer.

Representative examples of ethylene/unsaturated ester copolymers may include ethylene/methyl acrylate, ethylene/methyl methacrylate, ethylene/ethyl acrylate, ethylene/ethyl methacrylate, ethylene/butyl acrylate, ethylene/2-ethylhexyl methacrylate, and ethylene/vinyl acetate.

Another useful ethylene copolymer is ethylene/(meth) acrylic acid, which is the copolymer of ethylene and acrylic acid, methacrylic acid, or both.

Useful propylene copolymer includes propylene/ethylene copolymers ("EPC"), which are copolymers of propylene and ethylene having a majority weight % content of propylene, such as those having an ethylene comonomer content of less than 10%, preferably less than 6%, and more preferably from about 2% to 6% by weight.

Ionomer is a copolymer of ethylene and an ethylenically unsaturated monocarboxylic acid having the carboxylic acid groups partially neutralized by a metal ion, such as sodium or zinc, preferably zinc. Useful ionomers may include those in which sufficient metal ion is present to neutralize from about 15% to about 60% of the acid groups in the ionomer. The carboxylic acid is preferably "(meth)acrylic acid"—which means acrylic acid and/or methacrylic acid. Useful ionomers include those having at least 50 weight % and preferably at least 80 weight % ethylene units. Useful ionomers also include those having from 1 to 20 weight percent acid units. Useful ionomers are available, for example, from Dupont Corporation (Wilmington, Del.) under the SURLYN trademark.

The film layer may have a composition such that any one of the above described polymers comprises at least about any of the following weight percent values: 30, 40, 45, 50, 55, 60, 65, 70, 75, 80, 85, 90, 95, and 100% by weight of the layer. Film layer may have a single layer construction, or may be formed from multiple layers for improved moisture barrier properties. In one embodiment the film layer may be formed from substantially the same polymer, such as low density polyethylene, as is used to form foam layer, or from a different polymer which is adhered to the foam layer. In other embodiments, the foam layer may be formed from a low density form of a polymer, while film layer may be formed from a high density form of the same polymer.

The thickness of the film layer is selected to provide sufficient material to permit the formation of the plurality of recesses in the outer surface. The film layer may have a thickness of at least about any of the following values: 1 mils, 1.25 mils, 1.5 mils, 2 mils, 2.5 mils, 3 mils, 5 mils, 10 mils, and 20 mils. The film layer may have a thickness ranging from about 3 to about 20 mils, more preferably from about 5 to about 15 mils, and still more preferably about 10 mils. Further, the thickness of the film layer as a percentage of the total thickness of the underlayment material may range (in ascending order of preference) from about 1 to about 50 percent, from about 5 to about 45 percent, from about 10 to about 45 percent, from about 15 to about 40 percent, from about 15 to about 35 percent, and from about 15 to about 30 percent. The film layer may have a thickness relative to the thickness of the underlayment material of at least about any of the following values: 1%, 5%, 10%, 20%, and 30%.

The foam layer may comprise a variety of different foamed polymeric materials including polyolefins. Suitable polyolefins may include polyethylene resins, including polyethylene homopolymers and copolymers. Useful polyethylene homopolymers include low-density polyethylene (LDPE), linear low-density polyethylene (LLDPE), and high-density polyethylene (HDPE). Polyethylene copolymers may include homogeneous ethylene/alpha-olefin copolymers, such as metallocene/single-site catalyzed copolymers of ethylene and one or more $C_3$ to $C_{10}$ alpha-olefin comonomers, or heterogeneous Ziegler-Natta catalyzed ethylene/alpha-olefin copolymers. Other ethylene copolymers include propylene, higher olefins and carboxylic acids and esters. Various ethylene copolymers are used in which the second comonomer is a carboxylic acid or ester such as vinyl acetate, acrylic acid, methacrylic acid, methacrylate and ethyl acrylate. Ethylene vinyl acetate (EVA) copolymers with vinyl acetate content ranging up to 30% weight could be used copolymers, such as homogeneous ethylene/alpha-olefin copolymers, heterogeneous Ziegler-Natta catalyzed ethylene/alpha-olefin copolymers, and ethylene vinyl acetate (EVA) copolymers. Suitable polyolefin resins may also include polypropylene homopolymers and copolymers.

The foam layer provides many of the cushioning characteristics of the underlayment material. The thickness and density of the foam layer may be selected so that the underlayment material has the desired cushioning properties. In one embodiment the foam layer has a density from about 0.5 to 15 pcf. In other embodiments, the foam layer has a density that is from about 1.5 to 3.0 pcf, 1.7 to 2.5 pcf, and from 1.9 to 2.2 pcf. The thickness of the foam layer may range from about 0.01 to 3 inches, 0.1 to 2.0 inches, and from 0.75 to 1.5 inches. In one embodiment, the foam layer has a density from about 1.0 to 2.2 pcf and a thickness between about 0.20 to 1.5 inches.

In some embodiments, the foam layer may include a plurality of spaced apart ribs that extend at least partially along the length of the foam layer. The ribs may provide channels through which a fluid may migrate to the edges of the flooring system. Floor underlayment materials having a plurality of ribs are discussed in greater detail in commonly assigned U.S.

patent applications Ser. Nos. 10/716,922 and 10/758,402, the contents of which are hereby incorporated by reference.

In some embodiments, the film layer may also include one or more additives, such as antioxidants, anti-corrosion agents, UV stabilizers, fire retardants, fire resistants, anti-bacterial agents, anti-microbial agents, anti-fungal agents, anti-static agents, biostabilizers and/or other functional additives depending on the commercial application of the laminate.

The underlayment material may be used in a wide variety of applications including flooring applications. As discussed above, the underlayment material may be used in finished flooring applications where it may be desirable to prevent water from accumulating between the floor and the subfloor. Finished floors may include one or more of wood planks, parquet flooring, wood laminate flooring, or wood-block flooring. In one alternative embodiment the floor may comprise a laminate wood floor including wood laminates which are commercially available. In other embodiments, the underlayment material may be used in conjunction with other types of flooring systems including linoleum and tile floors.

In one embodiment, the floor may comprise wood or laminate planks that are positioned side-by-side on the underlayment material. In one alternative embodiment, the planks may fit together by means of tongue-in-groove arrangement. In some embodiments, the floor may be a so-called "floating floor."

The subfloor may include precast or preformed concrete, poured concrete, or reinforced concrete. In one embodiment, the flooring system comprises a wood subfloor in combination with an underlayment material having low barrier properties. In such an embodiment, a low barrier underlayment material may help permit the escape of fluid from within the flooring system and thereby prevent the accumulation of moisture between the wood subfloor and the underlayment material.

The flooring system may be assembled in any known manner. In one embodiment, the underlayment material is positioned on a concrete subfloor in a free-lying manner. The floor may be in the form of strips of wood or laminate planks. In some embodiments, the underlayment material may not be adhered to the concrete subfloor. In one alternative embodiment, the bottom of the foam layer contacts the top surface of concrete subfloor and the outer surface of the film layer may be at least partially in contact with the underside of the floor. Planks of laminate wood flooring may be positioned on the underlayment material in a free-lying manner. Planks may fit together by means of tongue-in-groove arrangement and in some embodiments may be glued together. The outer surface of the film layer contacts the bottom surface of laminate wood flooring.

The following examples are provided for the purpose of illustration only and should not be construed as limiting the invention in any way.

EXAMPLES

Example 1

A twin-screw extruder was used for making a Sample A foam as mentioned in Table 1. A 2.0 MI, 0.919 g/cc LDPE resin was used. The resin rate was 405 lb/hr which included 10% of recycled material. The aging modifier (blend of glycerol monostearate and monodiethanolamide) was added at 5.2 lb/hr. Talc masterbatch from Colortech was added at 7.6 lb/hr along with black coloring agent. To expand the foam, propane was injected as a physical foaming agent. The propane was mixed with the LDPE and cooled prior to exiting the die. The cooled mixture was extruded through an annular sheet die. The melt temperature was at 232 F and the die pressure was at 610 psi. The final density is about 1.85 pounds per cubic feet having a thickness of 0.155 inch. Then, the foam was wound in a form of a roll and cured.

After the foam was cured, a 10 mil thick film was extrusion coated on top of the foam and then embossed using the cast lamination process. A single screw extruder was used to cast extrude a 10 mil LDPE film. The cured foam was passed through an embossing roll to produce a plurality of recesses on the surface of the film layer. The embossing roll imprinted a plurality of recesses on the surface of the film layer in a diamond-shaped pattern similar to the one shown in FIG. 1*a*. For example, the area of each diamond was approximately 0.014 $in^2$. Similarly, the other patterns can be embossed. The same grade LDPE as described before along with 2% carbon black were used to produce a black-colored embossed film. The film contained about 50% of virgin resin and about 50% of recycled material from the same resin. The recycled content in the film can be increased up to 100%.

TABLE 1

| | Units | Sample A | Test Method |
|---|---|---|---|
| Film thickness | (mil) | 10 | — |
| Foam thickness | (inch) | 0.155 | — |
| Average Recess Depth | (mil) | 17 | — |
| Compression strength @ 25% | (psi) | 3.1 | ASTM D3575-00 Suffix D |
| Compression strength @ 50% | (psi) | 12.6 | ASTM D3575-00 Suffix D |
| Tensile MD | (psi) | 125.4 | ASTM D412-98 |
| Tensile cMD | (psi) | 104.5 | ASTM D412-98 |
| Tear MD | (psi) | 23.8 | ASTM D624-00 |
| Tear cMD | (psi) | 32.0 | ASTM D624-00 |
| MD Elongation | (%) | 112.9 | ASTM D412-98 |
| cMD Elongation | (%) | 93.2 | ASTM D412-98 |
| Compression Set | (%) | 35.0 | ASTM D3575-00 Suffix B |
| Thermal Stability | (%) | 0.3 | ASTM D3575-00 Suffix S |
| WVTR* | (g/day/100 $in^2$) | 0.23 | ASTM F1249-01 |
| STC Rating | No units | 54 | ASTM E90 |
| IIC Rating | No units | 59 | ASTM E492 |

*Water Vapor Transmission Rate (WVTR) was measured at 100° F. and 90% relative humidity Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A floor underlayment material comprising:

a foam layer; and a film layer having an inner surface attached to said foam layer and an outer surface including a plurality of recesses disposed thereon, the recesses defining one or more fluid pathways through which a fluid is migratable along the outer surface of the film layer, and wherein the fluid pathways comprise a plurality of interconnected diamond-shaped recesses or a plurality of interconnected wave-shaped recesses.

2. The floor underlayment material according to claim 1, wherein an embossing roll is used to form the recesses so that the recesses comprise a plurality of imprinted depressions on the outer surface of the film layer.

3. The floor underlayment material according to claim 1, wherein the one or more fluid pathways comprise a network of interconnected recesses through which a fluid is migratable.

4. The floor underlayment material according to claim 1, wherein the recesses cover at least 5 percent of the surface area of the outer surface.

5. The floor underlayment material according to claim 1, wherein heat is transferred from the underlayment material to a fluid disposed in the one or more fluid pathways so that a cross-sectional slice of the underlayment material has temperature variation of 150° F. or less.

6. The floor underlayment material according to claim 5, wherein the fluid comprises air.

7. The floor underlayment material according to claim 1, wherein the film layer comprises low density polyethylene having a moisture vapor transmission rate of about 0.2 grams/day/100 $in^2$ at 100° F., 90% relative humidity as per ASTM F1249-01.

8. The floor underlayment material according to claim 1, wherein the film layer comprises a thermoplastic material having a moisture vapor transmission rate no greater than about 0.25 grams/day/100 $in^2$ at 100° F., 90% relative humidity as per ASTM F 1249-01.

9. The floor underlayment material according to claim 1, wherein the thickness of the film layer is between 3 and 20 mils.

10. The floor underlayment material according to claim 1, wherein the recesses have a depth that is at least about 3 mils.

11. The floor underlayment material according to claim 1, wherein the recesses have an average depth that is about 5 mils.

12. The floor underlayment material according to claim 1, wherein the foam layer comprises a polyolefin.

13. The floor underlayment material according to claim 1, wherein the foam layer comprises low density polyethylene foam having a density from about 1.0 to 2.2 pcf and a thickness of about 0.20 to 1.5 inches.

14. The floor underlayment material according to claim 1, wherein the foam layer and the film layer each comprises a material that is substantially the same polymer.

15. A floor underlayment material configured to substantially prevent the accumulation of trapped fluids between the underlayment material and a floor, the underlayment material comprising:

a foam layer comprising low density polyethylene and having a density that is from about 1.0 to 2.2 pcf and a thickness of about 0.20 to 1.5 inches; and a low density polyethylene film layer attached to the foam layer, the film layer including an inner surface attached to the foam layer and an outer surface having one or more fluid pathways disposed thereon, wherein the one or more fluid pathways define channels through which a fluid may escape from between a floor and the underlayment material, whereby the accumulation of trapped fluids is substantially prevented, and wherein the fluid channels comprise a plurality of interconnected diamond-shaped recesses or a plurality of interconnected wave-shaped recesses.

16. The floor underlayment material according to claim 15, wherein the foam layer is thermally bonded to the film layer.

17. The floor underlayment material according to claim 15, wherein the fluid pathways cover between 20 and 50 percent of the surface of the film layer.

18. The floor underlayment material according to claim 15, wherein the fluid pathways comprise a plurality of imprinted depressions on the surface of the film layer.

19. The floor underlayment material according to claim 18, wherein the film layer is about 8 to 12 mils thick and the plurality of imprinted depressions have a depth that is about 2 to 6 mils.

20. The floor underlayment material according to claim 15, wherein the film layer has a moisture vapor transmission rate of about 0.2 grams/day/100 $in^2$ at 100° F., 90% relative humidity as per ASTM F 1249-01.

21. The floor underlayment material according to claim 15, wherein the foam layer extends in a length direction and includes an outer surface having a plurality of spaced ribs projecting therefrom, the plurality of spaced ribs oriented in the length direction.

* * * * *

UNITED STATES PATENT AND TRADEMARK OFFICE

CERTIFICATE OF CORRECTION

PATENT NO. : 7,651,757 B2
APPLICATION NO. : 11/216777
DATED : January 26, 2010
INVENTOR(S) : Jones et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1183 days.

Signed and Sealed this

Twenty-third Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,651,757 B2
APPLICATION NO. : 11/216777
DATED : January 26, 2010
INVENTOR(S) : Jones et al.

It is certified that error appears in the above-identified patent and that said Letters Patent is hereby corrected as shown below:

Column 13,
Line 16, "150°F." should read --15°F.--.

Signed and Sealed this
Fourteenth Day of June, 2011

David J. Kappos

David J. Kappos
*Director of the United States Patent and Trademark Office*